US006645025B2

(12) United States Patent
Oathout

(10) Patent No.: US 6,645,025 B2
(45) Date of Patent: Nov. 11, 2003

(54) PADDLE SUPPORT HAVING A STORAGE DEVICE

(76) Inventor: David E. Oathout, 129 Fulton Rd., Caroga Lake, NY (US) 12032

( * ) Notice: Subject to any disclaimer, the term of this patent is extended or adjusted under 35 U.S.C. 154(b) by 0 days.

(21) Appl. No.: 09/998,312

(22) Filed: Dec. 3, 2001

(65) Prior Publication Data

US 2003/0040233 A1 Feb. 27, 2003

Related U.S. Application Data

(63) Continuation-in-part of application No. 09/934,676, filed on Aug. 23, 2001.

(51) Int. Cl.[7] ..... B63H 16/06
(52) U.S. Cl. ..... 440/104; 440/106
(58) Field of Search ..... 440/101–110; 114/363, 364; D12/215

(56) References Cited

U.S. PATENT DOCUMENTS

| | | | | | |
|---|---|---|---|---|---|
| 468,960 | A | * | 2/1892 | Vondersaar | 440/109 |
| 1,736,155 | A | * | 11/1929 | Harter | 114/354 |
| 2,299,178 | A | * | 10/1942 | Reiter | 114/363 |
| 3,347,060 | A | * | 10/1967 | Barkan | 62/457.9 |
| 4,068,611 | A | * | 1/1978 | Leather | 440/105 |
| 4,266,707 | A | * | 5/1981 | Rossman | 224/275 |
| 4,290,156 | A | * | 9/1981 | Rawson | 440/101 |
| 4,809,352 | A | * | 2/1989 | Walker | 383/3 |
| 5,050,526 | A | * | 9/1991 | Nelson et al. | 114/364 |
| 5,481,822 | A | * | 1/1996 | Engels | 43/54.1 |
| 5,605,112 | A | * | 2/1997 | Schuman | 114/343 |
| 6,052,939 | A | * | 4/2000 | McClain et al. | 43/54.1 |
| 6,068,402 | A | * | 5/2000 | Freese et al. | 383/110 |

FOREIGN PATENT DOCUMENTS

| | | | | |
|---|---|---|---|---|
| FR | 2577512 | * | 8/1986 | 440/104 |
| GB | 6872 | * | of 1893 | 440/102 |
| GB | 2101946 | * | 1/1983 | 440/104 |

* cited by examiner

*Primary Examiner*—S. Joseph Morano
*Assistant Examiner*—Ajay Vasudeva
(74) *Attorney, Agent, or Firm*—Oliff & Berridge, PLC

(57) ABSTRACT

A paddle support having a storage device assists in rowing a vessel. The paddle is retained in the upper portion of a support that has a base section that may be connected to the storage device or a support strap. The storage device may rest directly on the floor of the vessel, or may be suspended over the opening of a vessel by a support strap. The storage device may be a backpack, bag, box or insulated cooler. The use of the support strap allows the storage device and support to be used with a watertight skirt or covering stretched over the opening of the vessel.

13 Claims, 5 Drawing Sheets

PADDLE SUPPORT HAVING A STORAGE DEVICE

RELATED APPLICATION

This application is a Continuation in Part of U.S. application Ser. No. 09/934,676 filed Aug. 23, 2001. The entire disclosure of the prior application is herein incorporated by reference.

BACKGROUND OF THE INVENTION

1. Field of Invention

This invention relates to a paddle support for a vessel having a storage device that provides a place for storing items while also allowing a rower to rest a paddle, while rowing a vessel or while the vessel is at rest.

2. Description of Related Art

The use of paddle supports and oar locks to assist in rowing a vessel is well-known in the prior art. Typically these devices provide support for an oar or paddle and may also provide leverage to the rower during operation. These devices may be attached to the outer hull of a vessel, or they may be mounted on the floor of the vessel with a post that extends upward, to engage a paddle or an oar at a height which facilitates the individual rower. Stand-alone storage devices, such as backpacks and drink coolers, are also well-known to the prior art.

SUMMARY OF THE INVENTION

Paddle supports can be removably or permanently attached to a vessel during operation. This requires the paddle to be fixed in a position prior to operation. While this may provide the rower with both leverage and support, it also restricts his range of motion when manipulating the paddle. If a rower accidentally removes a paddle from the support, he must direct his time and attention to returning the paddle to an operating position within the support. Thus, these devices require the rower to make a conscious effort to return the paddle to the support before rowing may continue. In addition, these devices do not allow the rower to reposition the support laterally without either removing and reattaching the support, or making some other type of adjustment. Further, a rower may find it necessary from time to time to push the vessel away from fixed objects, such as rocks or piers, or to push debris away from the vessel itself. In these situations, the necessity to remove and replace the paddle in the support may become problematic. This may be especially so when the vessel is moving rapidly through areas with many fixed objects, i.e., areas of rivers and streams containing rapids. In these situations, the ability of the rower to quickly and freely manipulate the paddle may be crucial in preventing injury to the rower, as well as damage to the vessel.

The efficient use of space in a small vessel such as a kayak or canoe, can also be of concern. For example, the cockpit area of a kayak can be very constraining and the space available for storage is limited or non-existent. While storage devices such as backpacks and coolers may be attached directly to the hull of the kayak the rower's access to these devices may be limited while the vessel is underway. Moreover, the possibility exists that these devices could become unattached while the vessel is underway, for instance when a kayak or canoe tips or rolls upside down.

This invention provides an apparatus for supporting a paddle during the operation of a vessel that also has a secure storage device. The storage device is easily accessible by the rower during operation of the vessel. The paddle support of this invention utilizes a freestanding support section that is removably attached to the paddle. The paddle support need not be and is preferably not attached to the vessel. In one embodiment, the storage device is attached to the bottom of the paddle support. The storage device then rests freely on the bottom of the vessel. The rower may manipulate the paddle freely with the top portion of the support attached to the paddle and the bottom portion of the support attached to the storage device. In this embodiment, the paddle support is made up of a retainer at the top portion for retaining the paddle, an upright support section that may be adjusted or set to a proper height suitable for the rower, and a base section that is connected to a storage device and rests freely on the floor of the vessel. This arrangement allows the support to be manipulated laterally to facilitate the comfort of the rower and allows the paddle to be lifted vertically by the rower. This is especially advantageous in situations involving fast moving water, such as rapids, in that the rower can quickly manipulate the paddle to push off rocks and obstructions, returning just as quickly to rowing the vessel. While the storage device is attached to the bottom of the paddle support, the rower is still able to manipulate the paddle laterally and to lift the entire device including the storage device vertically.

The paddle support of this invention may be adjusted in height to facilitate the comfort of the individual rower. This aids in reducing arm fatigue, by allowing the rower to operate the paddle in a range of motion which is most comfortable. It also allows the rower to rest the weight of the paddle and the rower's arms on the support during periods when the vessel is not being actively rowed.

In vessels such as canoes and kayaks, a rower may use a skirt to prevent water from entering the vessel. Typically, the skirt would cover the area between the rower's body and the edge of the inside of the vessel; for example, the exposed cockpit area of a kayak. The paddle supports of the prior art are not particularly conducive for use with a skirt, because a support must either be attached a considerable distance away from the rower's body, or must penetrate the skirt itself, creating a point where water may enter the vessel. In addition, because the supports of the prior art are in a fixed position and attached to the vessel itself there is a greater possibility of injury to the rower when operating in rough water conditions. One embodiment of the current invention alleviates this condition, allowing for use of the paddle support and storage device with a skirt.

In this embodiment, a piece of webbing or support strap is removably attached to the outer hull of the vessel extending across the opening covered by the skirt in front of the rower. The upright support portion of the paddle support is then attached to the support strap at the center portion of the vessel opening. One or more storage devices may then be attached to the webbing. The webbing is maintained in tension over the opening by the weight of the rower's arms, paddle, storage device and support itself bearing down on the center of the webbing. In this way the support may be maintained close to the rower's body without interfering with the watertight skirt. The height of the support may be varied by manipulating the upright support section itself or by adjusting the overall length of the webbing suspended over the opening.

In another embodiment, the storage device itself may have support straps extending from the bottom of the storage device across the vessel opening and connecting to the rim of the kayak. Lastly, the apparatus of this invention allows for easy removal and storage of the paddle support. This in turn facilitates the easy handling and transporting of the vessel, in that the entire paddle support apparatus with storage device is removed from the vessel leaving no outward projections which could hinder mounting and transporting on a vehicle.

These and other features and advantages of this invention are described in, or are apparent from, the following detailed descriptions of the preferred embodiments.

BRIEF DESCRIPTION OF THE DRAWINGS

The invention will be described with reference to the accompanying drawings in which like elements are labeled with like numbers in and which.

DETAILED DESCRIPTION OF PREFERRED EMBODIMENTS

Figure 1:
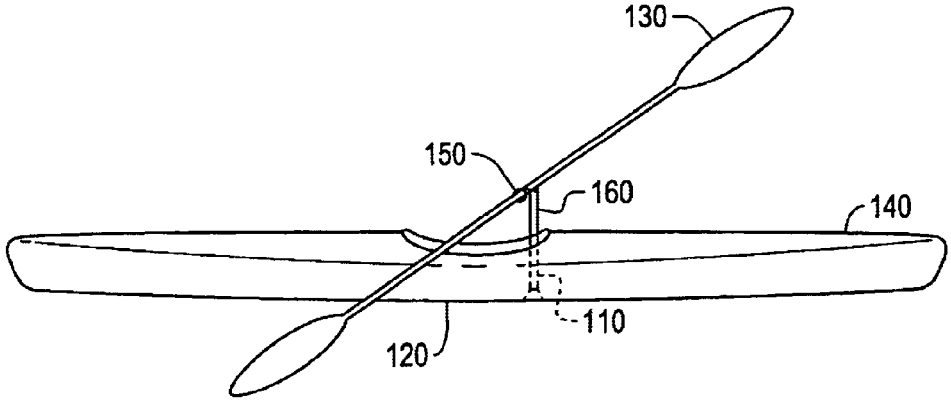
FIG. 1 shows an exemplary embodiment of a vessel, paddle and paddle support of this invention.

FIG. 1 is a longitudinal view of a typical vessel 140 with paddle support 160 shown in place. A paddle 130 is mounted to the top of the paddle support 160 by a retainer 150 at the upper portion of the support 160. The support 160 has a base member 110 that rests freely on the bottom 120 of the vessel 140. In this embodiment the paddle support 160 is not attached to the vessel in any way. This allows the rower the freedom to manipulate the paddle 130 with paddle support 160 connected without the encumbrance of having the paddle 130 physically attached to the vessel 140. Those skilled in the art will recognize that the support 160 may be used with a wide variety of vessels and is not limited to the vessels shown.

Figure 2:
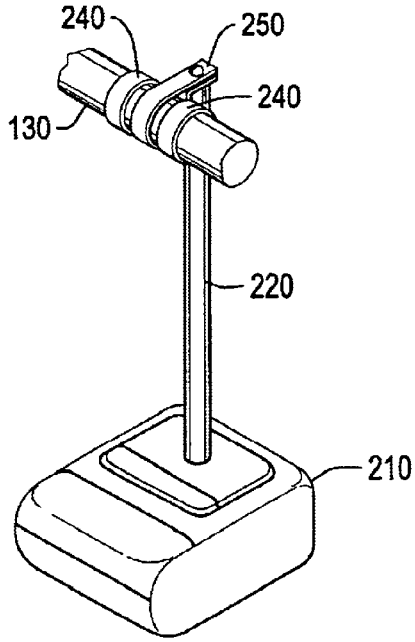
FIG. 2 is an exemplary embodiment of a paddle support and storage device of this invention.

FIG. 2 is an exemplary embodiment of the paddle support of this invention having a storage device 210 attached to the bottom of a paddle support 220. The storage device 210 rests freely on the bottom of the vessel and may be attached to the paddle support 220 by a threaded male connection extending through the storage device 210 and secured on the inside of the storage device 210 by a nut (not shown). The storage device 210 may also rest freely on a skirt or other such similar device intended to prevent water from entering the opening of a vessel. The paddle support 220 is movable in a lateral direction due to the flexible nature of the storage device 210. The paddle section 130 is attached to the paddle support 220 by means of a retainer 250 at the top portion of the paddle support 220. The paddle 130 is prevented from moving longitudinally within the retainer 250 by retainer clamps 240. The retainer clamps 240 may be of a rigid or flexible material and held in place with the use of screws or clips, or they may be permanently affixed to the paddle 130 by an adhesive. In this embodiment, the storage device 210 has been illustrated as having the form of a backpack or similar such device. One skilled in the art will recognize that the storage device could take various forms, such as boxes, bags, cases and other such devices that house one or more items.

Figure 3:
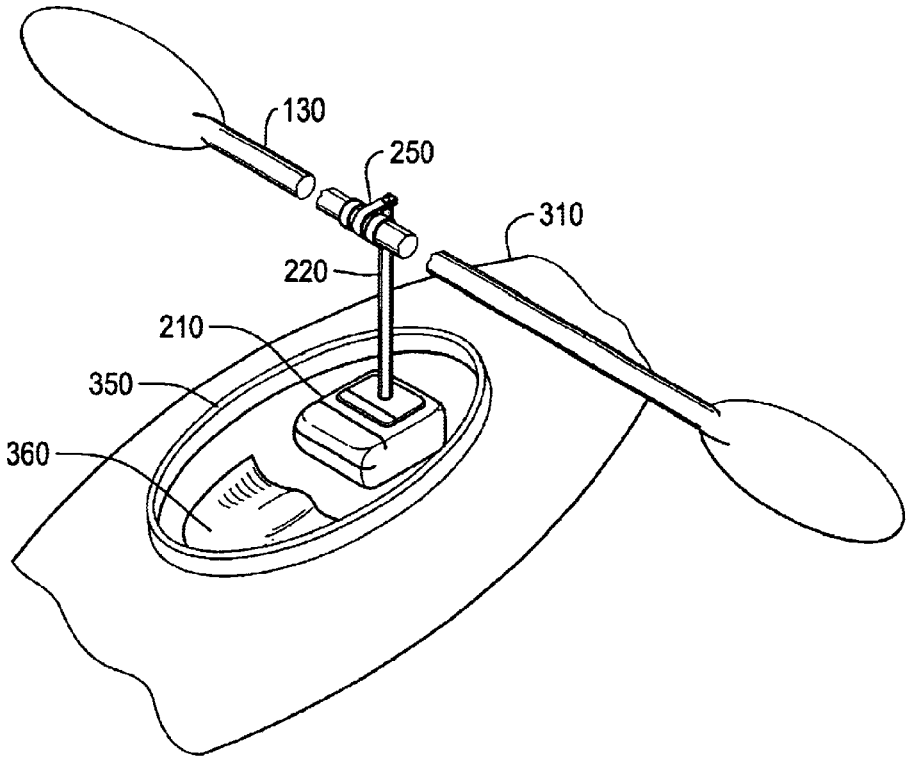
FIG. 3 is another exemplary embodiment of a paddle support, paddle and storage device of this invention located in a kayak.

FIG. 3 shows the paddle support and storage device of FIG. 2 in a kayak 310. A rower may be seated in seat 360 within kayak 310 and place the paddle support 220 with storage device 210 directly in front of the rower in the available space in the forward portion of the kayak cockpit 350. The paddle 130 is then fixed in the center portion to the support by means of retainer 250. In this embodiment, the paddle 130, paddle support 220 and storage device 210 may be lifted as a unit. The weight of the paddle 130 and paddle support 220, as well as the weight of the rower's arms are supported by the storage device 210 itself. The storage device 210 rests freely on the bottom of the kayak 310. In this way, the rower may position the entire device including the paddle 130 in a position that the rower finds most comfortable.

Figure 4:
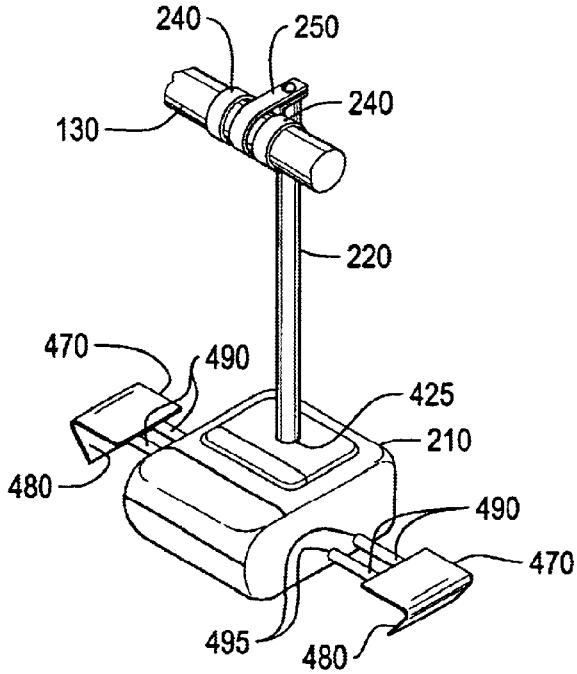
FIG. 4 is another exemplary embodiment of the paddle support of this invention having a storage device with an extendable support strap.

FIG. 4 is another exemplary embodiment of the paddle support 220 and storage device 210 of this invention having support straps 490 with hooks 470 for suspending the device over the cockpit of a kayak. In this embodiment, the paddle 130 is retained on the top of the paddle support 220 by the retainer 250. As discussed previously, the paddle is prevented from moving longitudinally by the retaining clamps 240. Paddle support 220 is mounted directly to the storage device 210 through a hole 425 in the top of the storage device. Paddle support 220 may be connected to the storage device by various means, for example a threaded male connection that passes through hole 425 and a nut (not shown) threaded onto the male connection from the inside of the storage device 210. Support straps 490 extend through holes 495 in the storage device 210. The support straps 490 are connected to retaining hooks 470 having contact portions 480 for holding the hooks 470 to the sides of a vessel. The support straps may also be connected to the side of a vessel by a hook and loop fastener system. The support straps 490 may be of an elastic material or may be adjustable to a proper length. The paddle support 220 and storage device 210 of this embodiment are particularly adapted for use in a kayak having a skirt covering the cockpit portion of the kayak. In this embodiment, the storage device 210 may be in contact with the top portion of the skirt. However, the load of the storage device 210, paddle support 220 and paddle 130 would be transferred to the rim of the kayak by support straps 490 and hooks 470.

Figure 5:
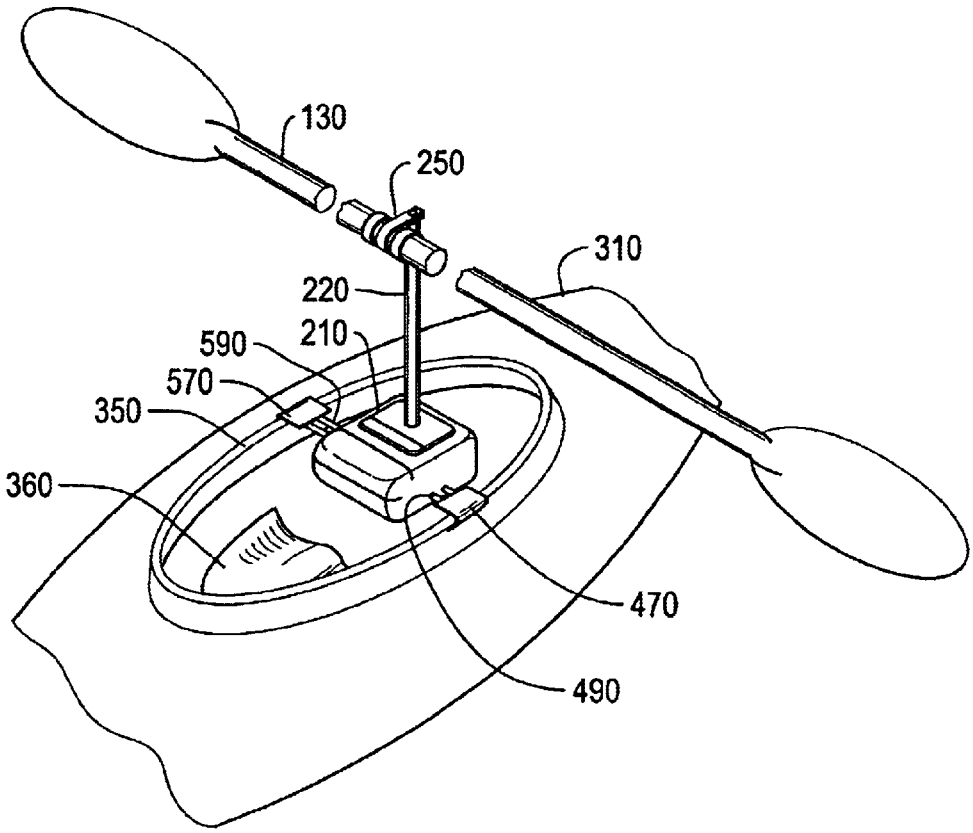
FIG. 5 is an exemplary embodiment of the paddle support of this invention having a storage device with support strap mounted in a kayak.

FIG. 5 illustrates the paddle support and storage device of FIG. 4 as installed in a kayak 310. Paddle 130, paddle support 220 and storage device 210 are suspended over the cockpit 350 of the kayak 310 by support straps 490. The support straps 490 are in turn connected to the rim of the cockpit 580 by retaining hooks 470. As discussed previously, this embodiment may be used when a skirt is extended over the opening of the cockpit 350 because the paddle support 220 need not extend through the skirt, thus creating a point where water could enter the vessel. The paddle support 220 and storage device 210 of this embodiment may also be used in the situation where no skirt has been placed over the kayak cockpit 350. In this arrangement, the storage device does not rest directly on the bottom of the kayak 310 and there is room for the rower's legs to extend below the storage device 210 and support straps 490. A further advantage of this embodiment is that the storage device 210, paddle support 220 and paddle 130 are physically connected to the kayak 310 in the event that the vessel rolls or the rower is unable to grip the paddle 130.

Figure 6:
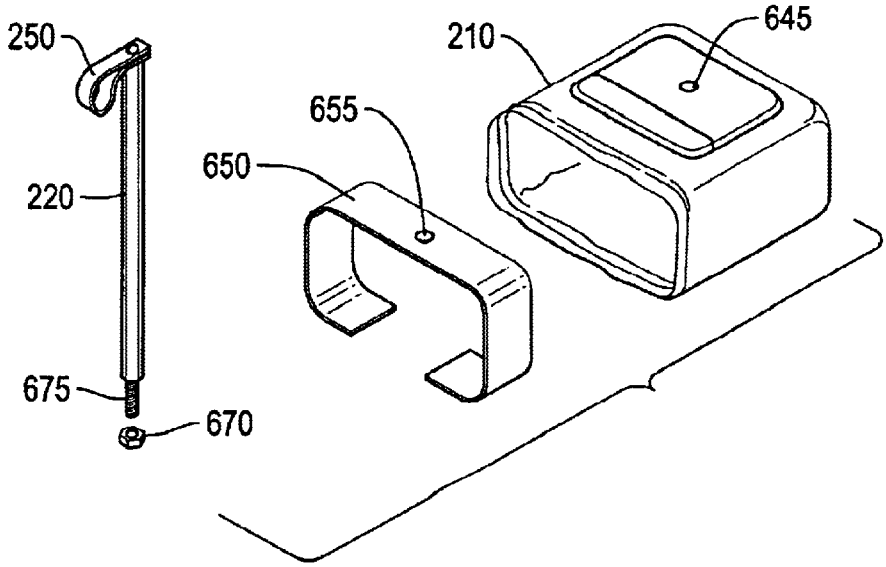
FIG. 6 is an exploded view of the paddle support of this invention having a storage device frame portion and paddle support.

FIG. 6 is an exploded view of the paddle support 220 and storage device 210 of FIGS. 2–5. As illustrated, a frame 650 fits inside the storage device 210. The frame 650 may be of a rigid material, such as plastic or metal, capable of supporting the weight of the paddle support 220, paddle, and rower's arms. Paddle support 220 is secured to the storage device 210 and frame 650 by a threaded connection 675 having a nut 670. The threaded portion 675 may be inserted into hole 645 in the storage device 210 and hole 655 in the frame 650 and then secured in place by nut 670. While the frame 650 may be of a generally rigid material, the material should be slightly flexible to allow lateral movement of the support 220. In this way, the rower is provided with a greater range of motion while manipulating the paddle.

Figure 7:
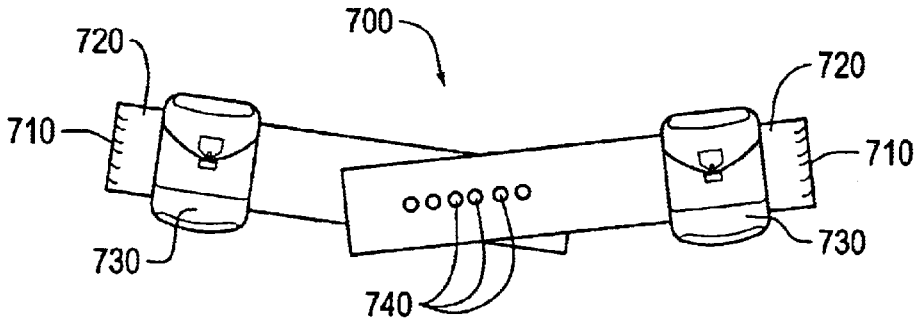
FIG. 7 is another exemplary embodiment of the support strap for the paddle support of this invention having storage devices attached to the support strap.

FIG. 7 illustrates a support strap 700 according to another embodiment of this invention having storage devices 730 mounted directly on flexible plates 720. In this embodiment, the support strap 700 is made up of two individual flexible plates 720 having holes 740 for connecting the plates 720 together. The plates 720 have hooked ends 710 that curve inward for connecting to the rim of a vessel. The plates 720 may be of a rigid or flexible material and are held together by inserting a threaded portion of a paddle support (not shown) through corresponding holes 740 to adjust the entire support 700 to the proper length. The paddle support may be as in previous embodiments. The storage devices 730 are then connected directly to the flexible plates 720. The storage devices 730 may be any number of devices capable of storing items, such as backpacks, boxes, bags and similar such containment type device that house one or more elements. Such elements may be electronics, such as fish-finder electronics.

Figure 8:
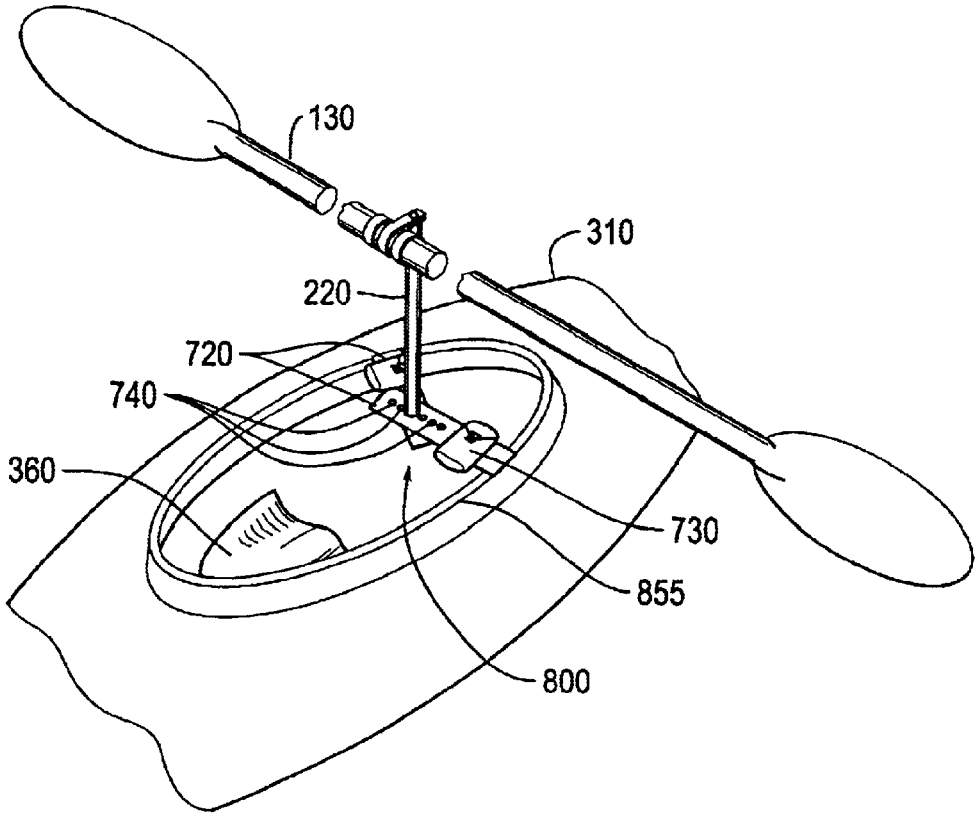
FIG. 8 is an exemplary embodiment of the paddle support of this invention mounted on the support strap having storage devices also mounted to the support straps.

FIG. 8 illustrates the support strap 700 of FIG. 7 as installed on a kayak 310. The support strap 700 is made up of individual flexible plates 720 connected together by a threaded portion (not shown) of paddle support 220. The threaded portion is inserted through holes 740 of flexible plates 720 and secured by a nut (not shown) on the bottom side of the support strap 700. The paddle 130 is supported by paddle support 220 and may be manipulated laterally due to the flexible nature of individual plates 720. The storage devices 730 are mounted to flexible plates 720. One skilled in the art will recognize that any number of storage devices may be mounted to the support strap 700. The rower, seated in seat 360 may position the support strap 700, paddle support 220 and paddle 130 in a location that is most comfortable to the rower.

Figure 9:
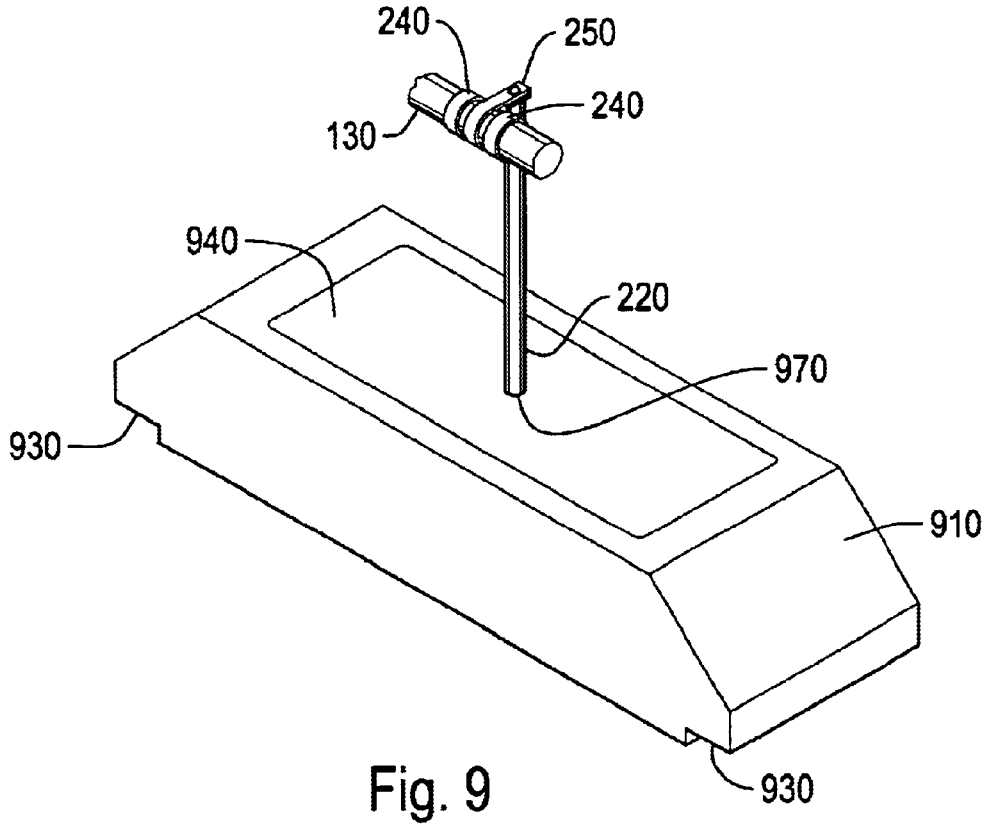
FIG. 9 is a perspective view of an exemplary embodiment of the paddle support of this invention mounted on a cooler.

FIG. 9 is an exemplary embodiment of a paddle support 220 of this invention having a cooler 910 as a storage device. The cooler 910 may be of a plastic, rubber or Styrofoam type material having thermodynamically insulating properties. The cooler 910 may be held or supported on a vessel by recessed portions 930. The recessed portions 930 may be individually located to fit the opening of a vessel. The cooler 910 has a lid 940 having hole 970 for mounting the paddle support 220. The weight of the rower's arms, paddle 130 and paddle support 220 are supported by the lid 940, which is in turn supported by the cooler 910. In this embodiment, the paddle support 220 may be loosely connected to the lid 940 to allow the rower to move the paddle 130 laterally. As previously discussed, the paddle is held at the top of the support 220 by retainers 250 and is prevented from moving longitudinally by retaining clamps 240.

Figure 10:
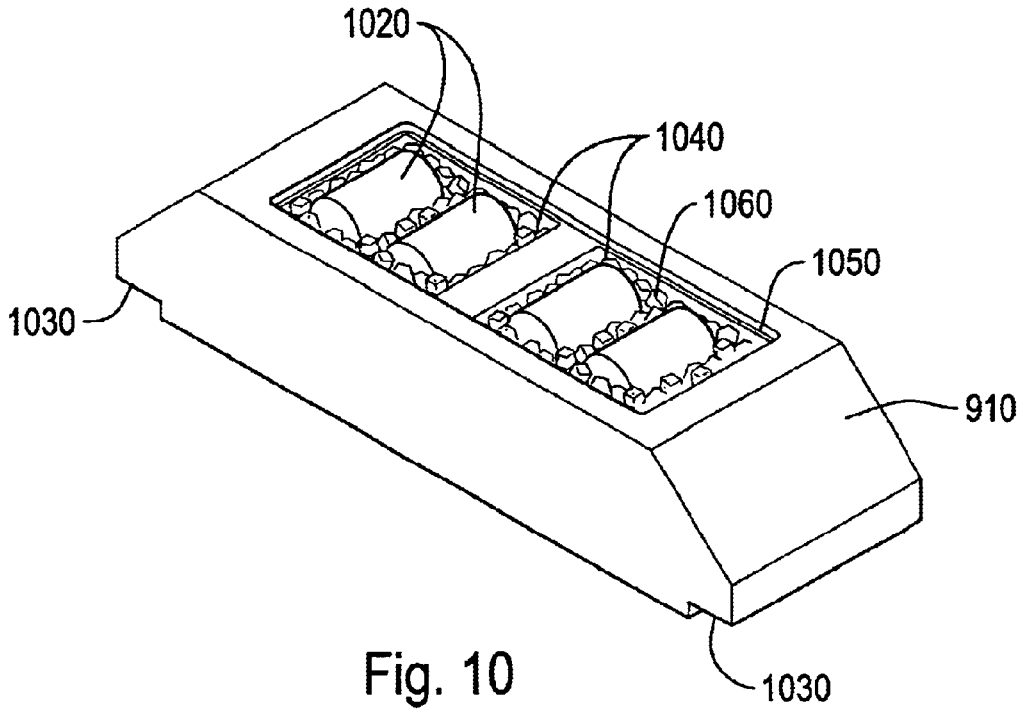
FIG. 10 is a perspective view of the cooler of FIG. 9 having the lid removed.

FIG. 10 is an illustration of the cooler 910 having the lid (not shown) removed. In this embodiment the inside of the cooler is partitioned into individual compartments 1060. The compartments 1060 are filled with ice 1040 for cooling the drink containers 1020. The cooler 910 has recesses 1030 that allow the cooler to be mounted on a vessel. One skilled in the art will recognize that the cooler 910 may be used for storing many items and is not limited to storing food or beverages. Additionally, the cooler may have any volume and may have any number of sub-compartments or no sub-compartments at all.

While this invention has been described in conjunction with specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A kayak paddle support, comprising:

an upright support member;

a retainer at a top portion of the upright support member for retaining a kayak paddle while allowing the kayak paddle to be manipulated in a range of operational motion; and a storage device having collapsible walls connected to the upright support member, wherein the storage device is a backpack.

2. The kayak paddle support according to claim 1, wherein the backpack has a frame that supports the weight of the kayak paddle support and paddle.

3. The kayak paddle support according to claim 2, wherein the kayak paddle support is mounted through the backpack onto the frame with a threaded connection and a bolt.

4. A kayak paddle support, comprising:

an upright support member;

a retainer at a top portion of the upright support member for retaining a kayak paddle while allowing the kayak paddle to be manipulated in a range of operational motion; and a storage device having collapsible walls connected to the upright support member, wherein the storage device has a support strap connectable to the sides of the vessel for suspending the kayak paddle support and storage device over the hull of a vessel.

5. The kayak paddle support according to claim 4, wherein ends of the support strap include a retaining hook connectable to the vessel.

6. The kayak paddle support according to claim 4, wherein the support strap is connected to left and right sides of the vessel by hook and loop fasteners.

7. The kayak paddle support according to claim 4, wherein the support strap is of an elastic material.

8. A paddle support for a vessel, comprising:

an upright support member;

a retainer at a top portion of the upright support member for retaining a paddle while allowing the paddle to be manipulated in a range of operational motion;

a support strap connected to the upright support member, wherein ends of the support strap include a retaining hook connectable to the vessel; and at least one storage device connected to the support member, wherein the support strap is connected to left and right sides of the vessel by hook and loop fasteners.

9. The paddle support according to claim 8, wherein the storage device is a backpack.

10. A paddle support for a vessel, comprising an upright support member;

a retainer at a top portion of the upright support member for retaining a paddle while allowing the paddle to be manipulated in a range of operational motion; and a cooler connected to the upright support member at the center of a top portion of the cooler.

11. The paddle support of claim 10, wherein the cooler rests on a hull of a vessel.

12. The paddle support of claim 10, wherein the cooler rests on a skirt of a vessel.

13. The paddle support of claim 10, wherein the cooler has plurality of recesses for mounting the cooler to a vessel.

* * * * *